US008866370B2

(12) United States Patent
Shibata et al.

(10) Patent No.: US 8,866,370 B2
(45) **Date of Patent: *Oct. 21, 2014**

(54) SPARK PLUG

(75) Inventors: Tsutomu Shibata, Owariasahi (JP); Takaaki Kikai, Ama (JP); Kenji Nunome, Nagoya (JP); Osamu Yoshimoto, Inazawa (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/516,874

(22) PCT Filed: Jan. 19, 2011

(86) PCT No.: PCT/JP2011/000254

§ 371 (c)(1),
(2), (4) Date: Jun. 18, 2012

(87) PCT Pub. No.: WO2010/056599

PCT Pub. Date: May 3, 2012

(65) Prior Publication Data

US 2012/0256530 A1 Oct. 11, 2012

(30) Foreign Application Priority Data

Oct. 26, 2010 (JP) ..... 2010-239610

(51) Int. Cl.
*H01T 13/39* (2006.01)
*H01T 13/32* (2006.01)

(52) U.S. Cl.
CPC ..... *H01T 13/39* (2013.01); *H01T 13/32* (2013.01)
USPC ..... 313/141; 313/142; 313/143

(58) Field of Classification Search
USPC ..... 313/118, 141–143, 145; 445/7
See application file for complete search history.

(56) References Cited

U.S. PATENT DOCUMENTS

2001/0025617 A1 10/2001 Kanao
2006/0170320 A1* 8/2006 Kumagai et al. ..... 313/141

(Continued)

FOREIGN PATENT DOCUMENTS

CN 1815830 A 8/2006
CN 101351939 A 1/2009

(Continued)

OTHER PUBLICATIONS

Office Action dated Jan. 25, 2013, issued by the Japanese Patent Office in counterpart Japanese Application No. 2011-520483.

(Continued)

*Primary Examiner* — Elmito Breval
(74) *Attorney, Agent, or Firm* — Sughrue Mion, PLLC

(57) ABSTRACT

A spark plug including a center electrode and a ground electrode having a core portion and an outer layer covering the core portion, the core portion being formed from a material having a thermal conductivity higher than that of the outer layer. At least a portion in which thickness of the outer layer is 0.5 mm or less is present at a cross-section perpendicular to a direction in which the ground electrode is extended. Further, the composition of the electrode material forming the outer layer is as follows: Ni is 96 mass % or more, total of at least one kind selected from Y and rare earth elements is 0.05 mass % or more, Al is 0.5 mass % or less, and Si is 0.5 mass % or more and 1.5 mass % or less, where the total of Ni, Y, rare earth elements, Al, Si does not exceed 100 mass %.

10 Claims, 2 Drawing Sheets

(56) References Cited

U.S. PATENT DOCUMENTS

| | | | | |
|---|---|---|---|---|
| 2007/0103046 | A1 | 5/2007 | Tinwell | |
| 2009/0009048 | A1 | 1/2009 | Yoshimoto et al. | |
| 2010/0003163 | A1* | 1/2010 | Kloewer et al. | 420/443 |
| 2010/0096968 | A1 | 4/2010 | Ban et al. | |
| 2010/0264803 | A1* | 10/2010 | Nunome et al. | 313/141 |
| 2012/0013241 | A1 | 1/2012 | Shibata et al. | |

FOREIGN PATENT DOCUMENTS

| | | | |
|---|---|---|---|
| CN | 102597284 | A | 7/2012 |
| EP | 1 143 587 | A2 | 10/2001 |
| EP | 1 686 665 | A1 | 8/2006 |
| EP | 2 012 398 | A2 | 1/2009 |
| EP | 2 161 802 | A2 | 3/2010 |
| EP | 2 214 274 | A1 | 8/2010 |
| JP | 2-295085 | A | 12/1990 |
| JP | 11-185928 | A | 7/1999 |
| JP | 2004-186152 | A | 7/2004 |
| JP | 2006-316343 | A | 11/2006 |
| JP | 2006-316344 | A | 11/2006 |
| JP | 2007-299670 | A | 11/2007 |
| JP | 2009-94047 | A | 4/2009 |

OTHER PUBLICATIONS

International Search Report (PCT/ISA/210), dated Mar. 22, 2011, issued by the International Searching Authority in corresponding International Application No. PCT/JP2011/000254.

Communication dated Sep. 16, 2013 from the State Intellectual Property Office of P.R. China in a counterpart application No. 201180007806.8.

Office Action dated Apr. 22, 2014 issued by the State Intellectual Property Office of the People's Republic of China in counterpart Chinese Patent Application No. 201180007806.8.

European Search Report dated Jul. 31, 2014 issued by the European Patent Office in corresponding European Application No. 11835747.4.

European Search Report dated Jul. 31, 2014 issued by the European Patent Office in corresponding European Application No. 11835746.6.

* cited by examiner

SPARK PLUG

TECHNICAL FIELD

The present invention relates to a spark plug, and particularly, to a spark plug including a core portion which is formed from materials having a high thermal conductivity in an inner portion of a ground electrode.

BACKGROUND ART

A spark plug is used for an ignition of an internal combustion engine such as an automobile engine. In general, the spark plug includes; a tubular metal shell; a tubular insulator which is disposed in an inner hole of the metal shell; a center electrode which is disposed in an inner hole of the leading end of the insulator; and a ground electrode in which one end is bonded to the leading end of the metal shell and the other end thereof forms a spark discharge gap between the ground electrode and the center electrode. In addition, the spark plug is spark-discharged at the spark discharge gap formed between the leading end of the center electrode and the leading end of the ground electrode in a combustion chamber of an internal combustion engine, and burns fuel filled in the combustion chamber.

However, in recent years, according to an output improvement by a supercharger, technology which lengthens the distance that can be traveled using a small amount of fuel has been developed. In this kind of internal combustion engine, temperature within the combustion chamber tends to be increased, and particularly, the temperature in the vicinity of an area, in which the leading end of the ground electrode is positioned, tends to be a high temperature. Moreover, according to miniaturization of the spark plug, the ground electrode is also thin. Therefore, the ground electrode cannot conduct heat generated by the discharge of the spark plug to escape to the metal shell (also referred to as "heat conduction"). As a result, the temperature of the ground electrode itself is also easily increased.

The spark plug is used under a high temperature environment as described above, if the spark plug has a configuration in which the temperature of the ground electrode is also easily increased, it is difficult to maintain a desired performance using the spark plug of the related art.

In Patent Document 1 having an object of providing a spark plug capable of decreasing a temperature increase of a ground electrode and of suppressing an extinction action thereof, a spark plug is disclosed in which a core having higher thermal conductivity than that of the ground electrode is embedded in at least a portion other than a curved portion of the ground electrode.

In Patent Document 2 having an object of providing an electrode material for a spark plug having excellent characteristics in oxidation resistance, spark wear resistance, and manufacturability, the following is disclosed. That is, it is necessary to enhance the thermal conductivity to improve the oxidation resistance of an alloy for the spark plug, and it is effective to enhance a melting pointing to improve the spark wear resistance. Thus, in order to simultaneously satisfy two necessary characteristics, in an electric material formed by high Ni-based alloy, adding a small amount of Si, adding a small amount of Hf and/or Re, decreasing Mn and Al, and adding one or more kinds of rare earth elements and/or Y by a small amount are simultaneously performed.

However, since there is a tendency for the inner portion of the combustion chamber to reach increasingly higher temperatures and for the spark plug to be miniaturized, a ground electrode having improved heat conduction is needed.

RELATED ART DOCUMENTS

Patent Documents

[Patent Document 1] JP-A-2007-299670
[Patent Document 2] JP-A-2006-316343

SUMMARY OF THE INVENTION

Problem that the Invention is to Solve

Therefore, the inventors considered the following. That is, if the ground electrode is formed from high Ni-based alloy having a high thermal conductivity and a core formed by Cu or the like having a high thermal conductivity is applied, temperature increase of the ground electrode can be decreased. At this time, if volume of the core is increased and the thickness of the high Ni-based alloy enclosing the core is decreased, the effect is even greater. However, according to the ground electrode described as above, problems were generated in that the high Ni-based alloy was easily oxidized under a cold and/or hot environment such as the inner portion of the combustion chamber and cracking was generated with a grain boundary oxidized as the starting point.

An object of the invention is to provide a spark plug capable of suppressing the occurrence of cracking with a grain boundary oxidized in an outer layer as the starting point under a cold and/or hot environment while decreasing temperature increase of a ground electrode.

Means for Solving the Problem

In order to achieve the object of the invention, there is provided a spark plug including a center electrode and a ground electrode having a gap between the center electrode and the ground electrode, wherein the ground electrode has at least a core portion and an outer layer covering the core portion, the core portion is formed from a material having higher thermal conductivity than that of the outer layer, at least a portion in which the thickness of the outer layer is 0.5 mm or less exists at a cross-section perpendicular to a direction in which the ground electrode is extended, and the composition of electrode material forming the outer layer is as follows: Ni is 96 mass % or more, the total of at least one kind selected from a group consisting of Y and rare earth elements is 0.05 mass % or more, Al is 0.5 mass % or less, and Si is 0.5 mass % or more and 1.5 mass % or less (here, the total of Ni, Y, rare earth elements, Al, Si does not exceed 100 mass %).

In the spark plug, the electrode material may be a composition containing at least one kind selected from a group consisting of Cr of 0.01 mass % or more and 0.5 mass % or less, Mn of 0.01 mass % or more and 2.5 mass % or less, and Ti of 0.01 mass % or more and 0.5 mass % or less.

In the spark plug, the electrode material may be a composition containing at least two kinds selected from a group consisting of Cr of 0.01 mass % or more and 0.5 mass % or less, Mn of 0.01 mass % or more and 2.5 mass % or less, and Ti of 0.01 mass % or more and 0.5 mass % or less.

In the spark plug, in the composition of the electrode material, C may be 0.001 mass % or more and 0.1 mass % or less.

In the spark plug, in the composition of the electrode material, the total of at least one kind selected from the group consisting of Y and the rare earth elements may be 0.45 mass % or less.

In the spark plug, in the composition of the electrode material, Mn may be 0.05 mass % or more, the total of at least one kind selected from an element group A consisting of Ti, V, and Nb may be 0.01 mass % or more, and a ratio (a/b) between the content (b) of Mn and total content (a) of the element group A may be 0.02 or more and 0.40 or less.

In the spark plug, the ratio (a/b) may be 0.03 or more and 0.25 or less.

In the spark plug, the ratio (a/b) may be 0.05 or more and 0.14 or less.

In the spark plug, in the composition of the electrode material, Al may be 0.01 mass % or more and 0.1 mass % or less.

In the spark plug, in the composition of the electrode material, Cr may be 0.05 mass % or more and 0.5 mass % or less.

In the spark plug, the electrode material may be a composition containing Ti.

Advantageous Effects of Invention

According to the spark plug of the invention, the spark plug includes the ground electrode that has the core portion formed from material having a high thermal conductivity and the outer layer covering the core portion, in which at least a portion in which the thickness of the outer layer is 0.5 mm or less exists, and, in the composition of the electrode material forming the outer layer, Ni is 96 mass % or more, the total of at least one kind selected from the group consisting of Y and rare earth elements is 0.05 mass % or more, Al is 0.5 mass % or less, and Si is 0.5 mass % or more and 1.5 mass % or less. Therefore, an outer layer having a high mechanical strength can be obtained, and the strength of the oxide layer formed on the surface of the outer layer is also high. Thus, a spark plug capable of suppressing the occurrence of cracking with a grain boundary oxidized in the outer layer under a cold and/or hot environment as the starting point while decreasing temperature increase of the ground electrode can be provided.

In addition, if the electrode material is the composition containing a specific ratio of at least one kind selected from the group consisting of Cr, Mn, and Ti, the strength of the oxide layer becomes high. Therefore, the grain boundary is not easily oxidized, and the occurrence of cracking with the grain boundary as the starting point can be further suppressed.

Moreover, if the electrode material is the composition containing C by a specific ratio, the electrode material having a high strength can be obtained. Therefore, progress of the cracking can be suppressed.

In addition, if the electrode material is the composition containing Mn by a specific ratio and the total of at least one kind selected from the element group A consisting of Ti, V, and Nb by a specific ratio, and the ratio (a/b) between the content (b) of Mn and the content (a) of the total of the element group A is within a specific range, it is thought that where a deposit attached to the electrode, that is, attached material such as oil or unburned fuel, and the electrode material react to each other, leading to the formation of a plurality of fine lumps of corrosive new foreign materials which easily become the starting point of cracking, the formation of the corrosive new foreign materials can be prevented. Therefore, the occurrence of cracking can be further suppressed.

If the electrode material is the composition containing Mn and element group A by a specific ratio, and Al or Cr by a specific ratio when the ratio (a/b) is within a specific range, a rigid oxide film is formed, the formation of the corrosive new foreign materials which are the starting point of cracking can be prevented, and the occurrence of cracking can be further suppressed.

DESCRIPTION OF EMBODIMENTS

A spark plug according to the invention includes a center electrode and a ground electrode, and one end of the center electrode and one end of the ground electrode are disposed so as to be opposite to each other via a gap. The ground electrode includes at least a core portion and an outer layer covering the core portion, the core portion is formed from a material having higher thermal conductivity than that of the outer layer. The spark plug according to the invention can adopt various known configurations without specifically limiting other configurations if the spark plug has the above-described configuration.

Figure 1:
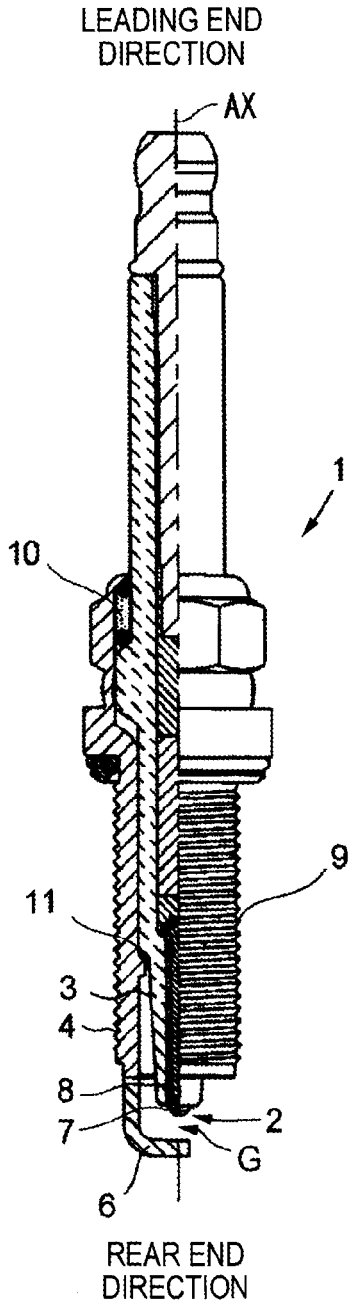
FIG. 1 is an explanatory view for explaining a spark plug which is an embodiment of a spark plug according to the invention, FIG. 1(*a*) is an entire explanatory view in which the spark plug of an embodiment of the spark plug according to the invention is shown in a partial cross-section, and FIG. 1(*b*) is an explanatory view in which a main portion of the spark plug of an embodiment of the spark plug according to the invention is shown in a cross-section.
Figure 1:
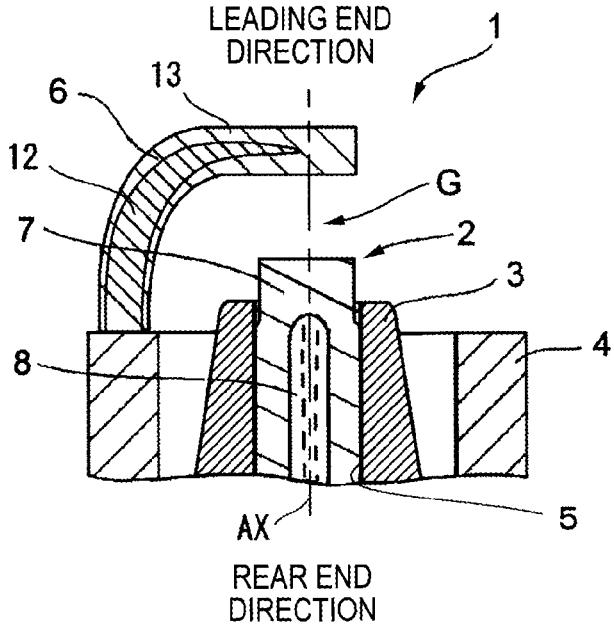

FIG. 1 shows a spark plug which is an embodiment of the spark plug according to the invention. FIG. 1(*a*) is an entire explanatory view in which the spark plug 1 of an embodiment of the spark plug according to the invention is shown in a partial cross-section, and FIG. 1(*b*) is an explanatory view in which a main portion of the spark plug of an embodiment of the spark plug according to the invention is shown in a cross-section. In addition, in FIG. 1(*a*), the downward surface of the paper is given as a leading end direction of an axis line AX and the upward surface of the paper is given as a rear end direction of the axis line AX. In FIG. 1(*b*), the upward surface of the paper is given as a leading end direction of the axis line AX and the downward surface of the paper is given as a rear end direction of the axis line AX.

As shown in FIGS. 1(*a*) and 1(*b*), the spark plug 1 includes: a center electrode 2 which is formed in an approximate bar-shape; an approximately tubular insulator 3 that is installed in the outer periphery of the center electrode 2; a tubular metal shell 4 that holds the insulator 3; and a ground electrode 6 in which one end is disposed to be opposite to the leading end surface of the center electrode 2 via a spark discharge gap G and the other end is bonded to the end surface of the metal shell 4.

The metal shell 4 is tubular and formed so as to hold the insulator 3 by housing the insulator 3. A screw portion 9 is formed at the outer periphery surface in the leading end direction of the metal shell 4, and the spark plug 1 is mounted to a cylinder head of an internal combustion engine (not shown) by using the screw portion 9. The metal shell 4 may be formed by a conductive ferrous material, for example, by low-carbon steel.

The insulator 3 is held to the inner periphery of the metal shell 4 via a talc 10 or a packing 11 and the like, and the insulator 3 includes a shaft hole 5 holding the center electrode 2 along the direction of the axis line of the insulator 3. The insulator 3 is fixed to the metal shell 4 in a state where the tip in the leading end direction of the insulator 3 is protruded from the leading end surface of the metal shell 4. It is preferable that material of the insulator 3 is material having a mechanical strength, a thermal strength, and an electric strength, for example, the material may be sintered ceramic consisting mainly of alumina.

The center electrode 2 includes an outer member 7 and an inner member 8 which are formed so as to be concentrically embedded in the axial center portion of the inner portion of the outer member 7. The center electrode 2 is fixed to the shaft hole 5 of the insulator 3 in a state where the leading end portion of the center electrode is protruded from the leading end portion of the insulator 3, and is held so as to be insulated with respect to the metal shell 4. The inner member 8 is preferably formed from material having higher thermal conductivity than that of the outer member 7, and the material of the inner member may be, for example, Cu, Ag, pure Ni, or the like. The outer member 7 may be formed from electrode material used in an outer layer of the ground electrode described hereinafter or any known material other than the electrode material.

The ground electrode 6 is formed, for example, in an approximately rectangular column. In addition, one end of the ground electrode 6 is bonded to the end surface of the metal shell 4, and the ground electrode 6 is bent in an approximate L-shape at the intermediate portion. The shape and the configuration of the leading end portion of the ground electrode 6 are designed so as to be disposed in the direction of the axis line of the center electrode 2. Due to the fact that the ground electrode 6 is designed as described above, one end of the ground electrode 6 is disposed to be opposite to the center electrode 2 via the spark discharge gap G. The spark discharge gap G is a gap formed between the leading end surface of the center electrode 2 and the surface of the ground electrode 6, and in general, the spark discharge gap G is set to 0.3 mm to 1.5 mm.

The ground electrode 6 includes a core portion 12 which is installed in the axial center portion of the ground electrode 6, and an outer layer 13 which houses the core portion 12. The spark plug of the invention adopts a configuration having improved heat conduction of the ground electrode 6 in order to decrease the temperature increase of the ground electrode 6. That is, volume of the core portion 12, which is formed from material having a higher thermal conductivity than that of the outer layer 13, is increased, and the thickness of the outer layer 13 is decreased. Therefore, a portion, in which the thickness of the outer layer is 0.5 mm or less at a cross-section perpendicular to a direction in which the ground electrode 6 is extended, exists in at least a portion of the ground electrode.

The shape of the core portion 12 is not particularly limited. That is, the shape of the core portion may be a bar-shape having the same diameter in the longitudinal direction, an elliptical body shape in which the leading end portion of the core portion is a small-diameter, an approximately rectangular columnar shape having the same shape as the ground electrode, or the like. In addition, not only the shape of the core portion 12, but also the position in which the core portion 12 is disposed at the inner portion of the ground electrode 6 is not particularly limited. According to the shape and the position of the core portion 12, the thickness of the outer layer 13 is not limited to be constant. For example, in a case where the shape of the core portion 12 is a bar-shape having the same diameter in the longitudinal direction and is the same shape as that of the ground electrode, when the core portion 12 is installed in the axial center of the ground electrode 6, the thickness of the outer layer 13 enclosing the outer periphery of the core portion 12 is the same in the entire direction perpendicular to the direction in which the ground electrode 6 is extended. However, in a case where the core portion 12 is eccentric in one end, the thickness of the outer layer 13 in the direction in which the core portion 12 is eccentric is the smallest. In addition, in the case where the thickness of the outer layer 13 is the same in the direction in which the ground electrode 6 is extended, the thickness of the outer layer 13 in the vicinity of the base end bonded to the metal shell 4 is the smallest. In the case where the thickness of the core portion is great going toward the tip, the thickness in the vicinity of the leading end portion of the outer layer opposite to the center electrode 2 is the smallest. As described above, the thickness of the outer layer 13 can adopt various shapes.

Next, the outer layer 13 will be described below. In general, the outer layer 13 is formed from electrode material referred to as high Ni-based alloy, and the core portion 12 is formed from material having higher thermal conductivity than that of the outer layer 13. For example, the material which forms the core portion 12 may be metal such as Cu, Cu alloy, Ag, Ag alloy, pure Ni.

In the ground electrode of the related art in which the outer layer 13 covering the core portion 12 is formed from low Ni-based alloy, for example, INCONEL 600 (Registered Trademark), or the like, cracking is not generated at the surface of the outer layer 13. However, due to the fact that high Ni-based alloy containing 96 mass % or more of Ni is adopted as the electrode material for forming the outer layer 13, the outer layer 13 is easily oxidized, and a problem occurs in that cracking occurs with the grain boundary oxidized as the starting point. Therefore, the inventors found that the occurrence of cracking with the grain boundary oxidized as the starting point can be suppressed due to the fact that composition of the electrode material forming the outer layer 13 is within a desired range. That is, due to the fact that the composition of the electrode material is within a desired range, the strength of the oxide layer formed on the surface of the outer layer 13 can be improved. Therefore, the grain boundary is not easily oxidized, and the occurrence of cracking with the grain boundary as the starting point can be suppressed. In addition, due to the fact that the composition of the electrode material is within a desired range, since the mechanical strength of the electrode material can be improved, the cracking progress can be suppressed.

The composition of the electrode material forming the outer layer 13 is as follows: Ni is 96 mass % or more, total of at least one kind selected from a group consisting of Y and rare earth elements is 0.05 mass % or more, Al is 0.5 mass % or less, and Si is 0.5 mass % or more and 1.5 mass % or less (here, the total of Ni, Y, rare earth elements, Al, and Si does not exceed 100 mass %).

The content of Ni in the electrode material is 96 mass % or more. Since Ni is a material having a high thermal conductivity, due to the fact that high thermal conductivity of the electrode material can be maintained, it is preferable that the content of Ni is 96 mass % or more. If the content of Ni is less than 96 mass %, the thermal conductivity of the electrode material is decreased, and the heat conduction of the ground electrode is deteriorated.

In the electrode material, the content of the total of at least one kind selected from the group consisting of Y and the rare earth elements is 0.05 mass % or more, and in general, the content of the total is 0.45 mass % or less. Since the mechanical strength of the electrode material is high due to the fact that the content of the total is 0.05 mass % or more, the cracking progress under a cold and/or hot environment can be suppressed. On the other hand, if the content of the total is less than 0.05 mass %, grain in the tissue of the electrode material is easily grown due to the fact that the ground electrode is subjected to high temperature. Therefore, the ground electrode is easily damaged and deformed. In addition, if the content of the total exceeds 0.45 mass %, the electrode material is too hard even though the mechanical strength is high, and the formability is deteriorated and mass production is difficult.

The rare earth elements may be Nd, La, Ce, Dy, Er, Yb, Pr, Pm, Sm, Eu, Gd, Tb, Ho, Tm, and Lu.

The content of Al in the electrode element is 0 mass % or more and 0.5 mass % or less. That is, Al is contained so as to not exceed 0.5 mass %. If the electrode material contains more than 0.5 mass % of Al, the thickness of the oxide layer formed on the surface of the outer layer is too thick and the original thickness of the outer layer is too thin. Therefore, cracking easily occurs.

The content of Si in the electrode material is 0.5% mass or more and 1.5 mass % or less. If the content of Si is within this range, oxide layer having a suitable thickness and high strength is formed on the surface of the outer layer. Therefore, the grain boundary is not easily oxidized, and the occurrence of cracking with the grain boundary as the starting point can be suppressed. If the Si content is less than 0.5 mass %, the thickness of the oxide layer becomes thin, and sufficient strength can be obtained. If the Si content exceeds 1.5 mass %, the thickness of the oxide layer is too thick and the original thickness of the outer layer becomes thin. Therefore, cracking easily occurs.

It is preferable that the electrode material has composition containing at least one kind selected from a group consisting of Cr of 0.01 mass % or more and 0.5 mass % or less, Mn of 0.01 mass % or more and 2.5 mass % or less, and Ti of 0.01 mass % or more and 0.5 mass % or less.

If the electrode material contains one kind or two kinds of Cr, Mn, and Ti within the range, the strength of the oxide layer formed on the surface of the outer layer is even greater. Therefore, the grain boundary is not easily oxidized, and the occurrence of cracking with the grain boundary as the starting point can be further suppressed. In addition, if the electrode material contains not one kind but two kinds of Cr, MN, and Ti, the effect becomes greater. The effect in a case where the electrode material contains all of Cr, Mn, and Ti is substantially the same as that in the case where the electrode material contains two kinds of Cr, Mn, and Ti.

It is preferable that C is 0.001 mass % or more and 0.1 mass % or less in the composition of the electrode material. If the content of C is within the range, the mechanical strength of the electrode material is great, and therefore, the cracking progress can be further suppressed. If the content of C exceeds 0.1 mass %, the electrode material is too hard even though the mechanical strength is great. Therefore, the formability is deteriorated and mass production is difficult.

In the composition of the electrode material, Mn is 0.05 mass % or more, the total of at least one kind selected from an element group A consisting of Ti, V, and Nb is 0.01 mass % or more. In addition, a ratio (a/b) between content of Mn (b) and content (a) of the total of the element group A is preferably 0.02 or more and 0.40 or less, more preferably 0.03 or more and 0.25 or less, and particularly preferably 0.05 or more and 0.14 or less.

If the content of Mn in the electrode material is 0.05 mass % or more, since a rigid oxide film is formed on the surface of the ground electrode which is formed from the electrode material, the occurrence of cracking can be suppressed. However, if the ground electrode is subjected to a high temperature and a high oxygen concentration environment, a plurality of fine lumps of corrosive new foreign materials occur on the surface of the ground electrode. The fine lumps of corrosive new foreign materials are considered to be formed due to the fact that C contained in deposit attached to the electrode, that is, attached material such as oil or unburned fuel, and the oxide film react to each other. If the fine lumps of corrosive new foreign materials are formed on the surface of the ground electrode, the occurrence of cracking with the corrosive new foreign materials as the starting point is easily generated.

Thus, if 0.01 mass % or more of the total of at least one kind selected from an element group A consisting of Ti, V, and Nb is contained in the electrode material in addition to the Mn, it was found that formation of the corrosive new foreign materials could be suppressed. If the electrode material contains at least one kind selected from the element group A, due to the fact that at least one kind selected from the element group A immerses the oxide film and traps C which is a source of the deposit, it is considered that the occurrence of the corrosive new foreign materials formed due to the reaction between the C and the oxide film of Mn can be suppressed. For example, Ti which traps C forms TiC. Since the TiC reacts with the oxide film of Mn and forms compound, the melting point of the oxide film of Mn is not lowered, and the oxide film of Mn can stably exist. As a result, it is considered that the corrosive new foreign materials are not easily formed.

Therefore, if not only the content of Mn and the content of the total of at least one kind selected from the element group A in the electrode material are a predetermined range, but also the ratio of the content (a) of the total of the element group A with respect to the content (b) of Mn is within the specific range as described above, the formation of the corrosive new foreign materials can be prevented, and as a result, the occurrence of cracking can be suppressed.

It is considered that any of Ti, V, and Nb has the effect which traps the C which is the source of the deposit and the effect which suppress formation of the corrosive new foreign materials. However, in terms of economy, it is particularly preferable that Ti is contained in the electrode material.

When the electrode material is the composition which contains Mn and the element group A within the range and the ratio between Mn and the element group is within the range, it is preferable that the content of Al is 0.01 mass % or more and 0.1 mass % or less. If the content of Al is within the range, Al combines with other elements such as Mn, and suppresses the occurrence of the corrosive new foreign materials. Therefore, a rigid oxide film is formed and the occurrence of cracking can be suppressed.

When the electrode material is the composition which contains Mn and the element group A within the range and the ratio between Mn and the element group A is within the range, it is preferable that the content of Cr is 0.05 mass % or more and 0.5 mass % or less. If the content of Cr is within the range, Cr combines with other elements such as Mn, the occurrence of the corrosive new foreign materials is suppressed. Therefore, a rigid oxide film is formed and the occurrence of cracking can be suppressed.

Electrode material forming the outer layer 18 contains Ni, at least one kind selected from a group consisting of Y and rare earth elements, and Si, if desired, contains substantially Al, Cr, Mn, Ti, C, V, and/or Nb. Within the content of each component described above, each component is contained so that total of each component and inevitable impurities is 100 mass %. Components other than the components, for example, S, P, Fe, Cu, B, Zr, Mg, and/or Ca may be contained as a minute amount of inevitable impurities. It is preferable that the inevitable impurities are contained in a small amount. However, the inevitable impurities may be contained within the range which can achieve the object of the invention. In addition, when the total mass of component described above is given as 100 parts by mass, the ratio of the above-described one kind of inevitable impurities may be 0.1 parts by mass or less, and the total ratio of all the kinds of inevitable impurities contained may be 0.2 parts by mass or less.

The content of each component contained in the electrode material can be measured as follows. That is, the electrode material is extracted (it is preferable that a carbon and sulfur analysis is 0.3 g or more and an ICP emission spectrometry is 0.2 g or more), the content of C is analyzed by carbon and sulfur analysis, and the contents of other components are analyzed by ICP emission spectrometry (Inductively coupled Plasma emission spectrometry), whereby mass analysis of the electrode material is performed. Ni is calculated from the remainder of the analysis values. In the carbon and sulfur analysis, pyrolysis of the extracted sample is performed at the combustion furnace, and the content of C is measured by performing a non-dispersive infrared detection (for example, EMIA-920V manufactured by HORIBA MFG. may be used as the carbon and sulfur analysis device). In the ICP emission spectrometry, the dissolution of the sample is performed through an acid digestion by using nitric acid or the like, and, after the qualitative analysis of the sample is performed, the quantity with respect to the detected element and the designated element is determined (for example, iCAP-6500 manufactured by THERMO FISHER may be as the ICP emission spectrometry device). The average value of the values, which are measured 3 times, is calculated in any analysis, and the average value is given as the content of each component in the electrode material.

In addition, predetermined raw materials are blended by predetermined blend ratios, and the electrode material is made as described below. The composition of the made electrode material substantially coincides with the composition of the raw materials. Therefore, the content of each component contained in the electrode material can be calculated from the blend ratios of the raw materials in a simple manner.

The ground electrode includes the core portion and the outer layer covering the core portion, the core portion is formed from material having higher thermal conductivity than that of the outer layer, and thickness of the outer layer is formed so as to be thin. In addition, even though the portion, in which the thickness of the outer layer is 0.5 mm or less, exists, if the electrode material forming the outer layer of the ground electrode has the above-described composition, the mechanical strength of the electrode material is great and strength of the oxide film is also great. Therefore, a spark plug can be provided in which temperature increase of the ground electrode is decreased and the occurrence of cracking with the grain boundary oxidized in the outer layer under the outer layer under a cold and/or hot environment as the starting point can be suppressed.

For example, the spark plug 1 is made as follows.

First, the manufacturing method of the ground electrode 6 will be described. The electrode material having the composition is molten and regulated, and the regulated electrode material is processed in a cup shape and manufactured as a cup body to be the outer layer 13. On the other hand, material such as Cu having higher thermal conductivity than that of the electrode material is molten, and manufactured as a bar-shaped body to be the core portion 12 by performing a hot working, a drawing process, or the like. The bar-shaped body is inserted to the cup body, and is plastically processed to a desired shape after performing plastic processing such as extruding processing. Thereafter, the ground electrode 6 having the core portion 12 in the inner portion of the outer layer 13 is manufactured.

The center electrode 2 can be manufactured by a method similar to the above-described method of the ground electrode 6 by using electrode material which has the same composition as that of the electrode material or known materials. In a case where the center electrode 2 is not provided with the inner member 8 formed by material having a high thermal conductivity in the inner portion, the center electrode 2 can be manufactured as follows. That is, molten metal of alloy having a predetermined composition is prepared, after an ingot is prepared from the molten metal, the ingot is appropriately regulated to a predetermined shape and a predetermined size by hot working, a drawing process, or the like, thus, the center electrode 2 is manufactured.

Subsequently, one end of the ground electrode 6 is bonded to the end surface of the metal shell 4, which is formed to a predetermined shape by plastic processing or the like, by electric resistance welding or laser welding or the like. Subsequently, Zn coating or Ni coating is applied to the metal shell to which the ground electrode is bonded. After the Zn coating and the Ni coating is performed, a trivalent chromate treatment may be performed. In addition, coating may be applied to the ground electrode, masking may be applied so that the coating is not attached to the ground electrode 6, and the coating attached to the ground electrode 6 may be separately peeled. Subsequently, the insulator 3 is manufactured by firing ceramic or the like to a predetermined shape, the center electrode 2 is assembled to the insulator 3 by known methods, and the insulator 3 is assembled to the metal shell 4 to which the ground electrode 6 is bonded. In addition, the leading end portion of the ground electrode 6 is bent to the center electrode 2 side, and the spark plug 1 is manufactured so that one end of the ground electrode 6 is opposite to the leading end portion of the center electrode 2.

The spark plug according to the invention is used for ignition of an internal combustion engine for automobile, for example, a gasoline engine or the like. That is, the screw portion 9 is screwed to a screw hole which is installed in a head (not shown) partitioning the combustion chamber of the internal combustion engine, and the spark plug is fixed to a predetermined position. The spark plug according to the invention can be used in any internal combustion engine. However, since the spark plug includes the ground electrode which suppresses the occurrence of cracking under a cold and/or hot environment while decreasing the temperature increase of the ground electrode, particularly, the spark plug can be appropriately used in an internal combustion engine in which the temperature of the combustion chamber is higher than that of the combustion chamber of the related art.

Figure 2:
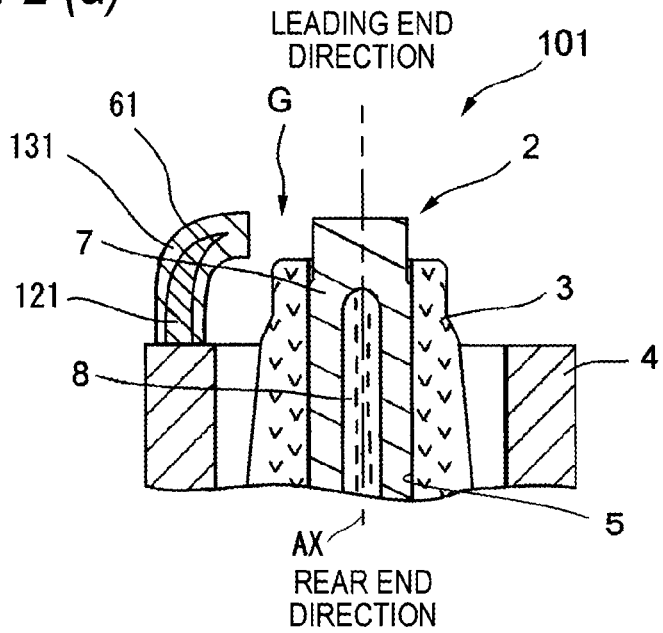
FIG. 2(*a*) is an explanatory view in which a main portion of a spark plug of another embodiment of a spark plug according to the invention is shown in a cross-section, and FIG. 2(*b*) is an explanatory view in which a main portion of a spark plug of still another embodiment of a spark plug according to the invention is shown in a cross-section.
Figure 2:
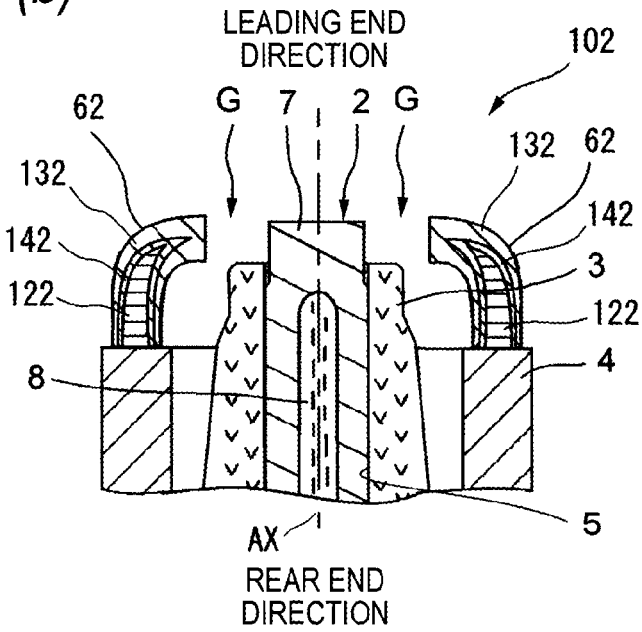

In addition, the spark plug 1 according to the invention is not limited to the above-described embodiment, and various modifications can be performed within the range which can achieve the object of the invention. For example, in the above-described spark plug 1, the leading end surface of the center electrode 2 and the surface of one end of the ground electrode 6 are disposed so as to be opposite to each other in the direction of the axis line AX via the spark discharge gap G. However, in the invention, as shown in FIG. 2, the side surface of the center electrode 2 and the leading end surfaces of one ends of ground electrodes 61, 62 may be disposed so as to be opposite to each other in the radial direction of the center electrode 2 via the spark discharge gap G. In this case, the ground electrodes 61 and 62 opposite to the side surface of the center electrode 2 may be installed singly as shown in FIG. 2(*a*), and may be installed in a plurality as shown in FIG. 2(*b*).

In the spark plug 1, as shown in FIG. 1(*b*), the ground electrode 6 is formed by the core portion 12 and the outer layer 13 covering the core portion 12. However, as shown in FIG. 2(*b*), the ground electrode 62 may be formed by a core portion 122, an outer layer 132 covering the core portion 122, and an intermediate layer 142 which is installed between the core portion 122 and the outer layer 132 so as to cover the core portion 122. For example, the outer layer 132 may be formed from the electrode material, the intermediate layer 142 may be formed from a metallic material having Cu as the main component, and the core portion 122 may be formed from pure Ni. In the ground electrode 62 having the configuration like this, heat conduction is excellent, the temperature of the ground electrode subjected to a high temperature can be effectively decreased. In addition, if the core portion is formed from pure Ni, deformation of the ground electrode can be prevented. Therefore, when the spark plug is mounted on the internal combustion engine, the ground electrode can be prevented from being erected.

In addition, the spark plug 1 includes the center electrode 2 and the ground electrode 6. However, in the invention, both or any one of the leading end portion of the center electrode and the surface of the ground electrode may have a noble metal tip. The noble metal tip, which is formed at the leading end portion of the center electrode and the surface of the ground electrode, generally has a circular column or a quadrilateral column, and is regulated to a suitable size. Thereafter, the noble metal tip is molten and fixed to the leading end portion of the center electrode and the surface of the ground electrode by a suitable welding method, for example, by a laser welding or an electrode resistance welding. In this case, a gap formed between two surfaces of two noble metal tips which face each other, or a gap between the surface of the noble metal tip and the surface of the center electrode 2 or the ground electrode 6 which is opposite to the noble metal tip serves as the spark discharge gap. For example, the material forming the noble metal tip may be noble metals such as Pt, Pt alloy, Ir, Ir alloy, or the like.

Embodiment

Spark Plug Sample Manufacture

By using a normal vacuum melting furnace, molten metal of an alloy having the compositions shown in Tables 1 to 4 was prepared, and ingots from each molten metal were prepared by vacuum casting. Thereafter, the ingots were made into round bars by hot casting, and a cup-shaped body as the outer layer was manufactured by forming the round bar into a cup shape. On the other hand, Cu or Cu alloy was made into a round bar by hot casting, and a bar-shaped body as the core portion was manufactured by performing hot working, a drawing process, or the like with respect to the round bar. The bar-shaped body was inserted into the cup-shaped body, by performing a drawing process after performing plastic processing such as an extruding process, and the ground electrode having the core portion of 1.3 mm×2.7 mm in the cross-sectional area was manufactured. In addition, with respect to the core portion, the core portions having three kinds of compositions were manufactured.

The core portion housed in the outer layer having the composition shown in Tables 1 and 2 used a core portion having a composition of 100 mass % of Cu. The core portion housed in the outer layer having the composition shown in Table 3 used a core portion having a composition of 99 mass % of Cu and 1 mass % of Cr. The core portion housed in the outer layer having the composition shown in Table 4 used a core portion having a composition of 98 mass % of Cu and 2 mass % of Cr.

The length of the ground electrode was 3 mm and the minimum value of the thickness of the outer layer at the cross-section surface perpendicular to the direction in which the ground electrode was extended was 0.4 mm.

Similar to the ground electrode having the core portion, a round bar was manufactured by regulating molten metal of an alloy having a composition shown in embodiment 12, and a ground electrode of 1.6 mm×2.8 mm in cross-sectional area without the core portion was manufactured by a drawing process, plastic processing, or the like.

In addition, by known methods, the one end of each one of the three kinds of ground electrodes having core portions in which the compositions of the outer layers were different from one another, and the one end of one of the ground electrodes without the core portion were bonded to one end surface of the metal shell. Subsequently, the center electrode was assembled to the insulator formed by ceramic, and the insulator was assembled to the metal shell to which the ground electrode was bonded. Moreover, only the leading end portion of the ground electrode without the core portion was bent to the center electrode side and the sample of the spark plug was manufactured so that one end of the ground electrode without the core portion was opposite to the leading end surface of the center electrode.

In addition, the diameter in the screw of the sample of the manufactured spark plug was M14 and the protruded dimension of the center electrode, which indicates the length protruded from the end surface of the insulator to the end surface of the center electrode in the direction of the axis line, was 1.5 mm. In addition, the diameter of the leading end of the center electrode was 2.5 mm and the protruded dimension of the insulator, which indicates the length protruded from the end surface of the metal shell to the end surface of the insulator in the direction of the axis line, was 1.5 mm. The spark discharge gap between the side surface of the center electrode and the surface of the ground electrode opposite to the center electrode was 1.1 mm.

The composition of the outer layer of the manufactured ground electrode was analyzed by the ICP emission spectrometry (iCAP-6500 manufactured by THERMO FISHER) and the carbon and sulfur analysis (EMIA-920V manufactured by HORIBA MFG).

Estimation Method

Cracking

The sample of the spark plug manufactured as described above was mounted on a 6-cylinder gasoline engine of 2000 cc. Thereafter, in a throttle full opening state, cycles performing idling for 1 minute after maintaining a state of the engine at 5000 rpm for 1 minute were repeated and the driving was performed for 200 hours. At this time, only the ground electrode without the core portion was discharged and the ground electrode having the core portion was not discharged. In addition, the spark plugs attached to the cylinders were alternated every 25 hours.

It was visually determined whether or not the cracking existed on the surface of the ground electrode having a core portion, and estimation was performed based on the following reference. The results are shown in Tables 1 and 2.

In addition, regarding the cracking, the cracking with the grain boundary oxidized as the starting point and the cracking with the corrosive new foreign materials as the starting point were observed, and the time when at least one crack was generated was measured.

x: A case where cracking was observed with driving of 75 hours or less.

O: A case where cracking was observed with driving of 100 hours or less.

©: A case where cracking was observed with driving of 125 hours.

◇: A case where cracking was observed with driving of 150 hours.

◆: A case where cracking was observed with driving of 175 hours.

◆◆: A case where cracking was observed with driving of 200 hours.

◆◆◆: A case where cracking was not observed with driving of 200 hours.

Corrosive New Foreign Materials

With respect to the formation state of the corrosive new foreign materials, it was visually determined by a magnifier (×50) whether or not the corrosive new foreign materials existed on the surface of the ground electrode, and estimation was performed based on the following reference. The results are shown in Tables 1 and 2.

x: A case where the corrosive new foreign materials were observed with driving of 125 hours.

O: A case where the corrosive new foreign materials were observed with driving of 150 hours.

©: A case where the corrosive new foreign materials were observed with driving of 175 hours.

◇: A case where the corrosive new foreign materials were observed with driving of 200 hours.

◆: A case where the corrosive new foreign materials were not observed with driving of 200 hours.

A comprehensive estimation in the Tables 1 and 2 was estimated based on the estimation results of the crack.

TABLE 1

| | | Composition (mass %) | | | | | | | | | | | | Determination | | |
|---|---|---|---|---|---|---|---|---|---|---|---|---|---|---|---|---|
| | | | | | | | | | Other Element | | | | | | | |
| | No. | Ni | Si | Cr | Mn | Al | Ti | Y | Kind | Content | C | Total | a/b | Crack | Corrosive new foreign materials | comprehensive estimation |
| Comparative Example | 1 | 100 | | | | | | | | | | 100.000 | — | X | ○ | X |
| Comparative Example | 2 | 98.9 | 1.1 | | | | | | | | | 100.000 | — | X | ○ | X |
| Comparative Example | 3 | 98 | 1.5 | | | 0.5 | | | | | | 100.000 | — | X | ○ | X |
| Comparative Example | 4 | 99.9 | | | | | | 0.1 | | | | 100.000 | — | X | ○ | X |
| Comparative Example | 5 | 99.8 | 0.1 | | | | | 0.1 | | | | 100.000 | — | X | ○ | X |
| Comparative Example | 6 | 99.6 | 0.3 | | | | | 0.1 | | | | 100.000 | — | X | ○ | X |
| Example | 7 | 99.4 | 0.5 | | | | | 0.1 | | | | 100.000 | — | ○ | ○ | ○ |
| Example | 8 | 99.39 | 0.5 | | | 0.01 | | 0.1 | | | | 100.000 | — | ○ | ○ | ○ |
| Example | 9 | 98.9 | 0.5 | | | 0.5 | | 0.1 | | | | 100.000 | — | ○ | ○ | ○ |
| Comparative Example | 10 | 98.4 | 0.5 | | | 1 | | 0.1 | | | | 100.000 | — | X | ○ | X |
| Example | 11 | 99.1 | 0.8 | | | | | 0.1 | | | | 100.000 | — | ○ | ○ | ○ |
| Example | 12 | 98.8 | 1.1 | | | | | 0.1 | | | | 100.000 | — | ○ | ○ | ○ |
| Example | 13 | 98.7 | 1.2 | | | | | 0.1 | | | | 100.000 | — | ○ | ○ | ○ |
| Example | 14 | 98.39 | 1.5 | | | 0.01 | | 0.1 | | | | 100.000 | — | ○ | ○ | ○ |
| Example | 15 | 97.9 | 1.5 | | | 0.5 | | 0.1 | | | | 100.000 | — | ○ | ○ | ○ |
| Comparative Example | 16 | 97.4 | 1.5 | | | 1 | | 0.1 | | | | 100.000 | — | X | ○ | X |
| Comparative Example | 17 | 97.9 | 2 | | | | | 0.1 | | | | 100.000 | — | X | ○ | X |
| Example | 18 | 98.79 | 1.1 | 0.01 | | | | 0.1 | | | | 100.000 | — | © | ○ | © |
| Example | 19 | 98.3 | 1.1 | 0.5 | | | | 0.1 | | | | 100.000 | — | © | ○ | © |
| Example | 20 | 97.8 | 1.1 | 1 | | | | 0.1 | | | | 100.000 | — | ○ | ○ | ○ |
| Example | 21 | 98.79 | 1.1 | | 0.01 | | | 0.1 | | | | 100.000 | — | © | ○ | © |
| Example | 22 | 98.3 | 1.1 | | 0.5 | | | 0.1 | | | | 100.000 | — | © | ○ | © |
| Example | 23 | 96.3 | 1.1 | | 2.5 | | | 0.1 | | | | 100.000 | — | © | ○ | © |
| Example | 24 | 96 | 1.1 | | 2.8 | | | 0.1 | | | | 100.000 | — | ○ | ○ | ○ |
| Example | 25 | 98.79 | 1.1 | | | | 0.01 | 0.1 | | | | 100.000 | — | © | ○ | © |
| Example | 26 | 98.3 | 1.1 | | | | 0.5 | 0.1 | | | | 100.000 | — | © | ○ | © |
| Example | 27 | 96.8 | 1.1 | | | | 2 | 0.1 | | | | 100.000 | — | ○ | ○ | ○ |
| Example | 28 | 98.85 | 1.1 | | | | | 0.05 | | | | 100.000 | — | ○ | ○ | ○ |
| Example | 29 | 98.45 | 1.1 | | | | | 0.45 | | | | 100.000 | — | ○ | ○ | ○ |
| Example | 30 | 98.3 | 1.1 | | | | | 0.6 | | | | 100.000 | — | ○ | ○ | ○ |
| Example | 31 | 98.45 | 1.1 | | | | | 0.1 | Nb | 0.35 | | 100.000 | — | ○ | ○ | ○ |
| Example | 32 | 98.45 | 1.1 | | | | | | Nb | 0.45 | | 100.000 | — | ○ | ○ | ○ |
| Example | 33 | 98.85 | 1.1 | | | | | | La | 0.05 | | 100.000 | — | ○ | ○ | ○ |
| Example | 34 | 98.85 | 1.1 | | | | | | Ce | 0.05 | | 100.000 | — | ○ | ○ | ○ |
| Example | 35 | 98.85 | 1.1 | | | | | | Dy | 0.05 | | 100.000 | — | ○ | ○ | ○ |
| Example | 36 | 98.85 | 1.1 | | | | | | Er | 0.05 | | 100.000 | — | ○ | ○ | ○ |
| Example | 37 | 98.85 | 1.1 | | | | | | Yb | 0.05 | | 100.000 | — | ○ | ○ | ○ |
| Example | 38 | 98.799 | 1.1 | | | | | 0.1 | | | 0.001 | 100.000 | — | ○ | ○ | ○ |
| Example | 39 | 98.79 | 1.1 | | | | | 0.1 | | | 0.01 | 100.000 | — | ○ | ○ | ○ |
| Example | 40 | 98.7 | 1.1 | | | | | 0.1 | | | 0.1 | 100.000 | | ○ | ○ | ○ |
| Example | 41 | 97.8 | 1.1 | 0.5 | 0.5 | | | 0.1 | | | | 100.000 | — | ◇ | ○ | ◇ |
| Example | 42 | 97.8 | 1.1 | 0.5 | | | 0.5 | 0.1 | | | | 100.000 | — | ◇ | ○ | ◇ |
| Example | 43 | 98.29 | 1.1 | 0.5 | | | | 0.1 | | | 0.01 | 100.000 | — | ◇ | ○ | ◇ |
| Example | 44 | 98.39 | 1.1 | | | | 0.5 | | | | 0.01 | 100.000 | — | ◇ | ○ | ◇ |
| Example | 45 | 98.3 | 1.1 | 0.2 | 0.2 | | 0.2 | | | | | 100.000 | — | ◇ | ○ | ◇ |

TABLE 1-continued

| | | Composition (mass %) | | | | | | | | | | | | Determination | | |
|---|---|---|---|---|---|---|---|---|---|---|---|---|---|---|---|---|
| | | | | | | | | | Other Element | | | | | | | |
| | No. | Ni | Si | Cr | Mn | Al | Ti | Y | Kind | Content | C | Total | a/b | Crack | Corrosive new foreign materials | comprehensive estimation |
| Example | 46 | 98.55 | 1.1 | 0.05 | 0.1 | | 0.05 | 0.15 | | | | 100.000 | — | ◇ | ○ | ◇ |
| Example | 47 | 96.89 | 1.1 | 0.4 | 0.7 | 0.3 | 0.5 | 0.1 | | | 0.01 | 100.000 | 0.71 | ◇ | ○ | ◇ |

TABLE 2

| | | Composition (mass %) | | | | | | | | | | | | Determination | | |
|---|---|---|---|---|---|---|---|---|---|---|---|---|---|---|---|---|
| | | | | | | | | | Other Element | | | | | | | |
| | No. | Ni | Si | Cr | Mn | Al | Ti | Y | Kind | Content | C | Total | a/b | Crack | Corrosive new foreign materials | comprehensive estimation |
| Example | 48 | 98.635 | 1.1 | 0.1 | 0.01 | 0.03 | 0.02 | 0.1 | | | 0.005 | 100.000 | 2.00 | ◇ | ○ | ◇ |
| Example | 49 | 98.597 | 1.1 | 0.1 | 0.048 | 0.03 | 0.02 | 0.1 | | | 0.005 | 100.000 | 0.42 | ◇ | ○ | ◇ |
| Example | 50 | 98.595 | 1.1 | 0.1 | 0.05 | 0.03 | 0.02 | 0.1 | | | 0.005 | 100.000 | 0.40 | ♦ | © | ♦ |
| Example | 51 | 98.565 | 1.1 | 0.1 | 0.08 | 0.03 | 0.02 | 0.1 | | | 0.005 | 100.000 | 0.25 | ♦♦ | ◇ | ♦♦ |
| Example | 52 | 98.505 | 1.1 | 0.1 | 0.14 | 0.03 | 0.02 | 0.1 | | | 0.005 | 100.000 | 0.14 | ♦♦♦ | ♦ | ♦♦♦ |
| Example | 53 | 98.245 | 1.1 | 0.1 | 0.4 | 0.03 | 0.02 | 0.1 | | | 0.005 | 100.000 | 0.05 | ♦♦♦ | ♦ | ♦♦♦ |
| Example | 54 | 97.945 | 1.1 | 0.1 | 0.7 | 0.03 | 0.02 | 0.1 | | | 0.005 | 100.000 | 0.03 | ♦♦ | ◇ | ♦♦ |
| Example | 55 | 97.645 | 1.1 | 0.1 | 1 | 0.03 | 0.02 | 0.1 | | | 0.005 | 100.000 | 0.02 | ♦ | © | ♦ |
| Example | 56 | 96.645 | 1.1 | 0.1 | 2 | 0.03 | 0.02 | 0.1 | | | 0.005 | 100.000 | 0.01 | ◇ | ○ | ◇ |
| Example | 57 | 98.595 | 1.1 | 0.1 | 0.01 | 0.03 | 0.06 | 0.1 | | | 0.005 | 100.000 | 6.00 | ◇ | ○ | ◇ |
| Example | 58 | 98.465 | 1.1 | 0.1 | 0.14 | 0.03 | 0.06 | 0.1 | | | 0.005 | 100.000 | 0.43 | ◇ | ○ | ◇ |
| Example | 59 | 98.455 | 1.1 | 0.1 | 0.15 | 0.03 | 0.06 | 0.1 | | | 0.005 | 100.000 | 0.40 | ♦ | © | ♦ |
| Example | 60 | 98.365 | 1.1 | 0.1 | 0.24 | 0.03 | 0.06 | 0.1 | | | 0.005 | 100.000 | 0.25 | ♦♦ | ◇ | ♦♦ |
| Example | 61 | 98.175 | 1.1 | 0.1 | 0.43 | 0.03 | 0.06 | 0.1 | | | 0.005 | 100.000 | 0.14 | ♦♦♦ | ♦ | ♦♦♦ |
| Example | 62 | 97.605 | 1.1 | 0.1 | 1 | 0.03 | 0.06 | 0.1 | | | 0.005 | 100.000 | 0.06 | ♦♦♦ | ♦ | ♦♦♦ |
| Example | 63 | 97.405 | 1.1 | 0.1 | 1.2 | 0.03 | 0.06 | 0.1 | | | 0.005 | 100.000 | 0.05 | ♦♦♦ | ♦ | ♦♦♦ |
| Example | 64 | 96.605 | 1.1 | 0.1 | 2 | 0.03 | 0.06 | 0.1 | | | 0.005 | 100.000 | 0.03 | ♦♦ | ◇ | ♦♦ |
| Example | 65 | 96.105 | 1.1 | 0.1 | 2.5 | 0.03 | 0.06 | 0.1 | | | 0.005 | 100.000 | 0.02 | ♦ | © | ♦ |
| Example | 66 | 98.315 | 1.1 | 0.1 | 0.25 | 0.03 | 0.1 | 0.1 | | | 0.005 | 100.000 | 0.40 | ♦ | © | ♦ |
| Example | 67 | 98.165 | 1.1 | 0.1 | 0.4 | 0.03 | 0.1 | 0.1 | | | 0.005 | 100.000 | 0.25 | ♦♦ | ◇ | ♦♦ |
| Example | 68 | 97.865 | 1.1 | 0.1 | 0.7 | 0.03 | 0.1 | 0.1 | | | 0.005 | 100.000 | 0.14 | ♦♦♦ | ♦ | ♦♦♦ |
| Example | 69 | 96.565 | 1.1 | 0.1 | 2 | 0.03 | 0.1 | 0.1 | | | 0.005 | 100.000 | 0.05 | ♦♦♦ | ♦ | ♦♦♦ |
| Example | 70 | 96.065 | 1.1 | 0.1 | 2.5 | 0.03 | 0.1 | 0.1 | | | 0.005 | 100.000 | 0.04 | ♦♦ | ◇ | ♦♦ |
| Example | 71 | 98.485 | 1.1 | 0.1 | 0.15 | | 0.06 | 0.1 | | | 0.005 | 100.000 | 0.40 | ♦ | © | ♦ |
| Example | 72 | 98.385 | 1.1 | 0.1 | 0.15 | 0.1 | 0.06 | 0.1 | | | 0.005 | 100.000 | 0.40 | ♦ | © | ♦ |
| Example | 73 | 98.395 | 1.1 | 0.1 | 0.24 | | 0.06 | 0.1 | | | 0.005 | 100.000 | 0.25 | ♦ | © | ♦ |
| Example | 74 | 98.385 | 1.1 | 0.1 | 0.24 | 0.01 | 0.06 | 0.1 | | | 0.005 | 100.000 | 0.25 | ♦♦ | ◇ | ♦♦ |
| Example | 75 | 98.295 | 1.1 | 0.1 | 0.24 | 0.1 | 0.06 | 0.1 | | | 0.005 | 100.000 | 0.25 | ♦♦ | ◇ | ♦♦ |
| Example | 76 | 97.635 | 1.1 | 0.1 | 1 | | 0.06 | 0.1 | | | 0.005 | 100.000 | 0.06 | ♦ | © | ♦ |
| Example | 77 | 97.625 | 1.1 | 0.1 | 1 | 0.01 | 0.06 | 0.1 | | | 0.005 | 100.000 | 0.06 | ♦♦♦ | ♦ | ♦♦♦ |
| Example | 78 | 97.535 | 1.1 | 0.1 | 1 | 0.1 | 0.06 | 0.1 | | | 0.005 | 100.000 | 0.06 | ♦♦♦ | ♦ | ♦♦♦ |
| Example | 79 | 98.205 | 0.5 | 0.1 | 1 | 0.03 | 0.06 | 0.1 | | | 0.005 | 100.000 | 0.06 | ♦♦♦ | ♦ | ♦♦♦ |
| Example | 80 | 97.205 | 1.5 | 0.1 | 1 | 0.03 | 0.06 | 0.1 | | | 0.005 | 100.000 | 0.06 | ♦♦♦ | ♦ | ♦♦♦ |
| Example | 81 | 98.555 | 1.1 | | 0.15 | 0.03 | 0.06 | 0.1 | | | 0.005 | 100.000 | 0.40 | ♦ | © | ♦ |
| Example | 82 | 98.505 | 1.1 | 0.05 | 0.15 | 0.03 | 0.06 | 0.1 | | | 0.005 | 100.000 | 0.40 | ♦ | © | ♦ |
| Example | 83 | 97.555 | 1.1 | 1 | 0.15 | 0.03 | 0.05 | 0.1 | | | 0.005 | 100.000 | 0.40 | ♦ | © | ♦ |
| Example | 84 | 98.465 | 1.1 | | 0.24 | 0.03 | 0.06 | 0.1 | | | 0.005 | 100.000 | 0.25 | ♦ | © | ♦ |
| Example | 85 | 98.415 | 1.1 | 0.05 | 0.24 | 0.03 | 0.06 | 0.1 | | | 0.005 | 100.000 | 0.25 | ♦♦ | ◇ | ♦♦ |
| Example | 86 | 97.965 | 1.1 | 0.5 | 0.24 | 0.03 | 0.06 | 0.1 | | | 0.005 | 100.000 | 0.25 | ♦♦ | ◇ | ♦♦ |
| Example | 87 | 97.465 | 1.1 | 1 | 0.24 | 0.03 | 0.08 | 0.1 | | | 0.005 | 100.000 | 0.25 | ♦ | © | ♦ |
| Example | 88 | 97.705 | 1.1 | | 1 | 0.03 | 0.08 | 0.1 | | | 0.005 | 100.000 | 0.06 | ♦ | © | ♦ |
| Example | 89 | 97.655 | 1.1 | 0.05 | 1 | 0.03 | 0.06 | 0.1 | | | 0.005 | 100.000 | 0.06 | ♦♦♦ | ♦ | ♦♦♦ |
| Example | 90 | 97.205 | 1.1 | 0.5 | 1 | 0.03 | 0.06 | 0.1 | | | 0.005 | 100.000 | 0.06 | ♦♦♦ | ♦ | ♦♦♦ |
| Example | 91 | 96.705 | 1.1 | 1 | 1 | 0.03 | 0.06 | 0.1 | | | 0.005 | 100.000 | 0.06 | ♦ | © | ♦ |
| Example | 92 | 98.595 | 1.1 | 0.1 | 0.05 | 0.03 | | 0.1 | V | 0.02 | 0.005 | 100.000 | 0.40 | ♦ | © | ♦ |
| Example | 93 | 98.595 | 1.1 | 0.1 | 0.05 | 0.03 | 0.01 | 0.1 | V | 0.01 | 0.005 | 100.000 | 0.40 | ♦ | © | ♦ |
| Example | 94 | 98.595 | 1.1 | 0.1 | 0.05 | 0.03 | | 0.1 | Nb | 0.02 | 0.005 | 100.000 | 0.40 | ♦ | © | ♦ |
| Example | 95 | 98.595 | 1.1 | 0.1 | 0.05 | 0.03 | 0.01 | 0.1 | Nb | 0.01 | 0.005 | 100.000 | 0.40 | ♦ | © | ♦ |
| Example | 96 | 97.605 | 1.1 | 0.1 | 1 | 0.03 | | 0.1 | V | 0.06 | 0.005 | 100.000 | 0.06 | ♦♦♦ | ♦ | ♦♦♦ |
| Example | 97 | 97.605 | 1.1 | 0.1 | 1 | 0.03 | 0.03 | 0.1 | V | 0.03 | 0.005 | 100.000 | 0.06 | ♦♦♦ | ♦ | ♦♦♦ |
| Example | 98 | 97.605 | 1.1 | 0.1 | 1 | 0.03 | | 0.1 | Nb | 0.06 | 0.005 | 100.000 | 0.06 | ♦♦♦ | ♦ | ♦♦♦ |
| Example | 99 | 97.605 | 1.1 | 0.1 | 1 | 0.03 | 0.03 | 0.1 | Nb | 0.03 | 0.005 | 100.000 | 0.06 | ♦♦♦ | ♦ | ♦♦♦ |
| Comparative Example | 100 | 75.95 | 0.5 | 15 | 0.3 | 0.2 | | | Fe | 8 | 0.05 | 100.000 | — | ♦♦♦ | ♦ | ♦♦♦ |

TABLE 3

| | | Composition (mass %) | | | | | | | | | | | | Determination | | |
|---|---|---|---|---|---|---|---|---|---|---|---|---|---|---|---|---|
| | | | | | | | | | Other Element | | | | | | Corrosive new | comprehensive |
| | No. | Ni | Si | Cr | Mn | Al | Ti | Y | Kind | Content | C | Total | a/b | Crack | foreign materials | estimation |
| Example | 101 | 98.7 | 1.2 | | | | | 0.1 | | | | 100.000 | — | ○ | ○ | ○ |
| Example | 102 | 98.3 | 1.1 | | 0.5 | | | 0.1 | | | | 100.000 | — | © | ○ | © |
| Example | 103 | 98.595 | 1.1 | 0.1 | 0.05 | 0.03 | 0.02 | 0.1 | | | 0.005 | 100.000 | 0.40 | ◆ | © | ◆ |
| Example | 104 | 97.605 | 1.1 | 0.1 | 1 | 0.03 | 0.06 | 0.1 | | | 0.005 | 100.000 | 0.06 | ◆◆◆ | ◆ | ◆◆◆ |

TABLE 4

| | | Composition (mass %) | | | | | | | | | | | | Determination | | |
|---|---|---|---|---|---|---|---|---|---|---|---|---|---|---|---|---|
| | | | | | | | | | Other Element | | | | | | Corrosive new | comprehensive |
| | No. | Ni | Si | Cr | Mn | Al | Ti | Y | Kind | Content | C | Total | a/b | Crack | foreign materials | estimation |
| Example | 105 | 98.7 | 1.2 | | | | | 0.1 | | | | 100.000 | — | ○ | ○ | ○ |
| Example | 106 | 98.3 | 1.1 | | 0.5 | | | 0.1 | | | | 100.000 | — | © | ○ | © |
| Example | 107 | 98.595 | 1.1 | 0.1 | 0.05 | 0.03 | 0.02 | 0.1 | | | 0.005 | 100.000 | 0.40 | ◆ | © | ◆ |
| Example | 108 | 97.605 | 1.1 | 0.1 | 1 | 0.03 | 0.06 | 0.1 | | | 0.005 | 100.000 | 0.06 | ◆◆◆ | ◆ | ◆◆◆ |

As shown in Tables 1 to 4, in the spark plug including the ground electrode formed from the electrode material which is within the range of the invention, the occurrence of cracking was suppressed in the outer layer of the ground electrode, and the corrosive new foreign materials were not easily formed. In addition, a similar effect could be obtained regardless of the composition of the core portion.

On the other hand, as shown in Tables 1 to 4, in the spark plugs having the electrode formed from the electrode material which is outside the range of the invention, cracking was observed in the ground electrode in the short driving time.

1, 101, 102: SPARK PLUG
2: CENTER ELECTRODE
3: INSULATOR
4: METAL SHELL
6, 61, 62: GROUND ELECTRODE
7: OUTER MEMBER
8: INNER MEMBER
9: SCREW PORTION
10: TALC
11: PACKING
12, 121, 122: CORE PORTION
13, 131, 132: OUTER LAYER
142: INTERMEDIATE LAYER
G: SPARK DISCHARGE GAP

The invention claimed is:

1. A spark plug comprising:

a center electrode and a ground electrode having a gap between the center electrode and the ground electrode, wherein the ground electrode has at least a core portion and an outer layer covering the core portion, the core portion is formed from a material having higher thermal conductivity than that of the outer layer, at least a portion in which thickness of the outer layer is 0.5 mm or less exists at a cross-section perpendicular to a direction in which the ground electrode is extended, and composition of electrode material forming the outer layer is as follows: Ni is 96 mass % or more, total of at least one kind selected from a group consisting of Y and rare earth elements is 0.05 mass % or more, Al is 0.5 mass % or less, and Si is from 0.5 mass % to 1.5 mass % (here, total of Ni, Y, rare earth elements, Al, Si does not exceed 100 mass %), wherein Mn is 0.05 mass % or more, total of at least one kind selected from an element group A consisting of Ti, V, and Nb is 0.01 mass % or more, and ratio (a/b) between the content (b) of Mn and total content (a) of the element group A is from 0.02 to 0.40 in the composition of the electrode material.

2. The spark plug according to claim 1, wherein the electrode material is a composition containing at least one kind selected from a group consisting of Cr of from 0.01 mass % to 0.5 mass %, Mn of from 0.05 mass % to 2.5 mass %, and Ti of from 0.01 mass % to 0.5 mass %.

3. The spark plug according to claim 1, wherein the electrode material is a composition containing at least two kinds selected from a group consisting of Cr of from 0.01 mass % to 0.5 mass %, Mn of from 0.05 mass % to 2.5 mass %, and Ti of from 0.01 mass % to 0.5 mass %.

4. The spark plug according to claim 1, wherein C is from 0.001 mass % to 0.1 mass % in the composition of the electrode material.

5. The spark plug according to claim 1, wherein total of at least one kind selected from the group consisting of Y and the rare earth elements is 0.45 mass % or less in the composition of the electrode material.

6. The spark plug according to claim 1, wherein the ratio (a/b) is from 0.03 to 0.25.

7. The spark plug according to claim 1, wherein the ratio (a/b) is from 0.05 to 0.14.

8. The spark plug according to claim 1, wherein Al is from 0.01 mass % to 0.1 mass % in the composition of the electrode material.

9. The spark plug according to claim 1, wherein Cr is from 0.05 mass % to 0.5 mass % in the composition of the electrode material.

10. The spark plug according to claim 1, wherein the electrode material is a composition containing Ti.

* * * * *